US007305768B2

(12) United States Patent
Hinderer

(10) Patent No.: US 7,305,768 B2
(45) Date of Patent: Dec. 11, 2007

(54) LOCKING MECHANISM FOR FOLDING TOOL

(75) Inventor: Rick Hinderer, Wooster, OH (US)

(73) Assignee: Mentor Group, LLC, Oregon City, OR (US)

( * ) Notice: Subject to any disclaimer, the term of this patent is extended or adjusted under 35 U.S.C. 154(b) by 218 days.

(21) Appl. No.: 11/207,048

(22) Filed: Aug. 18, 2005

(65) Prior Publication Data

US 2007/0039190 A1 Feb. 22, 2007

(51) Int. Cl.
*B26B 1/02* (2006.01)

(52) U.S. Cl. ..... 30/161; 30/155

(58) Field of Classification Search ..... 30/155, 30/160, 161, 158, 159
See application file for complete search history.

(56) References Cited

U.S. PATENT DOCUMENTS

| | | | | |
|---|---|---|---|---|
| 3,868,774 | A | 3/1975 | Miori | |
| 4,133,106 | A | 1/1979 | Addis | |
| 4,240,201 | A | 12/1980 | Sawby et al. | |
| 4,268,960 | A | 5/1981 | Reinschreiber | |
| 4,563,813 | A | 1/1986 | Fortenberry | |
| 5,060,379 | A | 10/1991 | Neely | |
| 5,095,624 | A | 3/1992 | Ennis | |
| 5,327,651 | A | 7/1994 | Favreau | |
| 5,331,741 | A | 7/1994 | Taylor, Jr. | |
| 5,502,895 | A * | 4/1996 | Lemaire | 30/158 |
| 5,511,310 | A | 4/1996 | Sessions et al. | |
| 5,615,484 | A | 4/1997 | Pittman | |
| 5,755,035 | A | 5/1998 | Weatherly | |
| 5,839,194 | A | 11/1998 | Bezold | |
| 5,964,035 | A | 10/1999 | Poehlmann | |
| 5,964,036 | A | 10/1999 | Centofante | |
| 6,079,106 | A | 6/2000 | Vallotton | |
| 6,256,887 | B1 | 7/2001 | Osborne | |
| 6,308,420 | B1 | 10/2001 | Moser | |
| 6,378,214 | B1 | 4/2002 | Onion | |
| 6,438,848 | B1 | 8/2002 | McHenry et al. | |
| 6,490,797 | B1 | 12/2002 | Lake et al. | |
| 6,574,869 | B1 | 6/2003 | McHenry et al. | |
| 6,701,621 | B2 | 3/2004 | Kain et al. | |
| 2001/0016987 | A1 * | 8/2001 | Chen | 30/161 |
| 2002/0029426 | A1 * | 3/2002 | Seber et al. | 7/128 |
| 2003/0070299 | A1 | 4/2003 | Frazer | |
| 2003/0208908 | A1 | 11/2003 | Kain et al. | |
| 2004/0154170 | A1 | 8/2004 | Kain et al. | |
| 2006/0059694 | A1 * | 3/2006 | Carter, III | 30/159 |
| 2006/0230620 | A1 * | 10/2006 | Steigerwalt et al. | 30/159 |
| 2006/0260137 | A1 * | 11/2006 | Flagg et al. | 30/160 |

* cited by examiner

*Primary Examiner*—Hwei-Siu C. Payer
(74) *Attorney, Agent, or Firm*—Hancock Hughey LLP

(57) ABSTRACT

A hand tool—typically embodied as a knife—incorporates a blade or implement lock mechanism for securely locking the implement such as a blade in the open position. The lock mechanism locks the blade in the open position and allows it to be released so that the blade may be folded back into the closed position. The locking mechanism incorporates a safety mechanism that prevents the blade engaging lock from becoming unintentionally disengaged.

19 Claims, 3 Drawing Sheets

LOCKING MECHANISM FOR FOLDING TOOL

FIELD OF THE INVENTION

This invention relates to hand tools such as knives and multi tools that incorporate folding implements, and more specifically to a blade or implement locking mechanism for use in such tools that facilitates secure locking of the implement in the open or extended position. The lock mechanism incorporates a safety mechanism.

BACKGROUND

Many types of hand tools such as knives and multi tools incorporate folding mechanisms that allow an implement to be moved between a folded position in which the implement is safely stowed in the tool handle, and an extended position in which the implement is ready for work. One typical example of such a folding tool is a knife having a folding blade. The knife handle typically has two opposed handle portions defining a blade-receiving groove. A blade pivots on a shaft attached to the handle such that in a folded position the blade is stowed with the cutting portion of the blade retained safely in the groove, and such that in an extended position the blade is extended away from the handle, ready for use.

To increase the safety of folding tools such as knives, many such tools incorporate locking mechanisms of one type or another. When the knife blade pivots into the open position, it's pivotal movement is stopped with a blocking mechanism such as a transverse blade stop pin housed in the handle. Many kinds of knives include a locking mechanism that prevents the blade from unintentionally pivoting back from the open into the closed position.

There are many types of locking mechanisms. One common type is a "liner lock." This kind of mechanism relies upon a resilient lever formed as part of a handle liner. When the blade is pivoted to the open or extended position, the resilient lever engages a cooperatively formed shoulder on the blade and thereby locks the blade in the open position.

There are other types of blade locks in addition to the liner locking mechanisms just described but there is a need therefore for improved locking mechanisms for folding hand tools.

The present invention relates to a hand tool—typically embodied as a knife—that incorporates a lock mechanism for securely locking the implement such as a blade in the open position, and for releasing the lock to allow the implement to be folded back into the closed position. The locking mechanism incorporates a safety mechanism that prevents the blade engaging lock from becoming disengaged unintentionally.

BRIEF DESCRIPTION OF THE DRAWINGS

The invention will be better understood and its numerous objects and advantages will be apparent by reference to the following detailed description of the invention when taken in conjunction with the following drawings.

In FIG. 1 the knife blade is stowed in the closed or folded position.

In FIG. 3, the blade is in the open position, the lock is in the locked position and the lock safety mechanism is in the locked or engaged position.

DETAILED DESCRIPTION OF THE PREFERRED EMBODIMENTS

A preferred embodiment of a hand tool 10 incorporating a locking mechanism and safety mechanism in accordance with the illustrated invention is shown in the figures. Although the invention is described with respect to its embodiment in a particular type of tool—a knife—it will be appreciated that references to this type of a knife, and indeed this particular type of hand tool, are for illustrative purposes to describe the invention. Those of ordinary skill in the art will appreciate that the invention claimed herein is not limited to knives, but instead extends to any hand tool having the features claimed herein.

Figure 1:
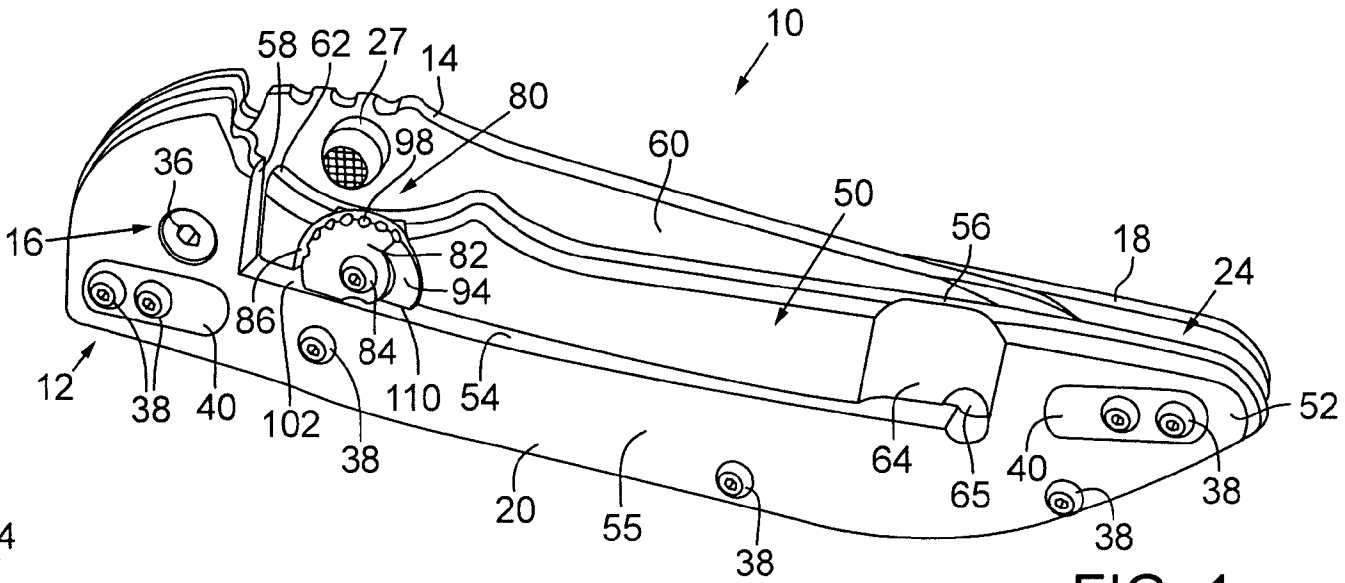
FIG. 1 is a perspective view of a hand tool—in this case a knife—incorporating a locking mechanism according to the present invention.
Figure 2:
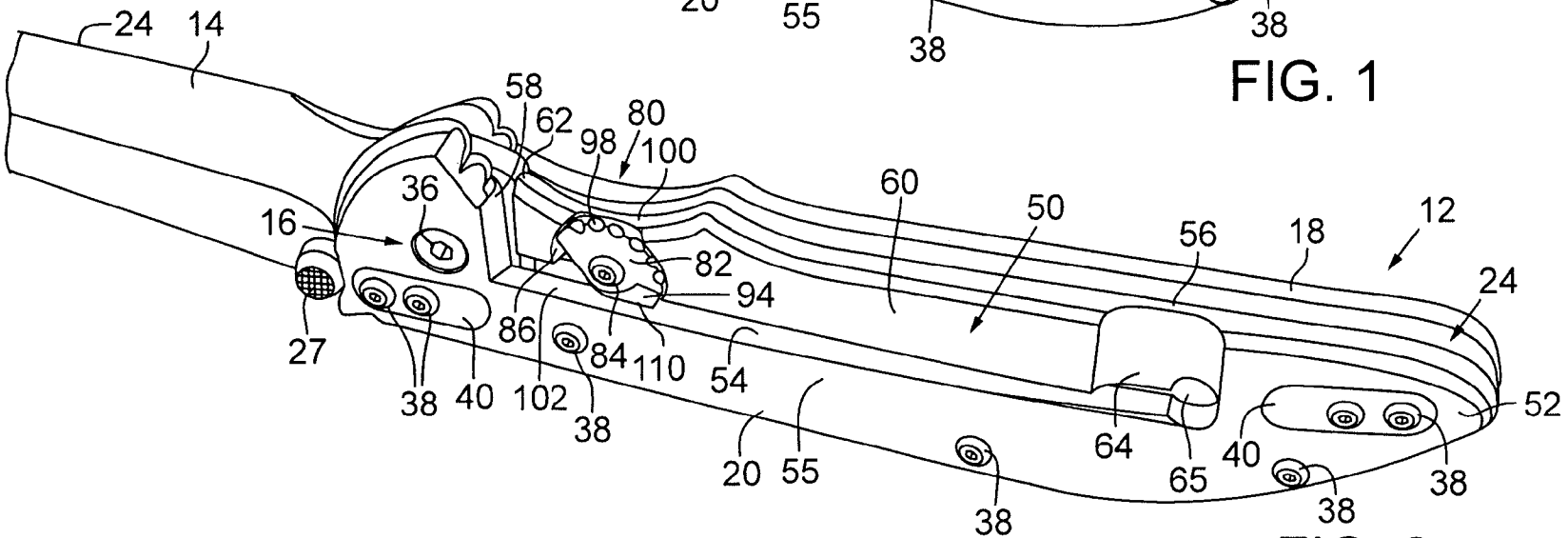
FIG. 2 is a perspective view of body the knife shown in FIG. 1 and a portion of the blade shown in the fully extended or open position to illustrate the locking mechanism engaging the rear of the tang of the blade and the lock safety mechanism.

With particular reference now to FIGS. 1 and 2, knife 10 includes a handle 12 with a blade 14 pivotally attached to one end of the handle at a blade pivot shaft 16. Handle 12 comprises three primary structural components, a first handle half or side wall 18, a second handle half or side wall 20, and a spacer 22 that is fixed therebetween when the knife is assembled (see, e.g., FIGS. 3, 8). Spacer 22 holds the handle halves 18 and 20 in a spaced apart orientation to define a blade-receiving groove or slot 24 between the halves. When the blade is in the closed position, the working portion 26 of blade 14 is safely stowed in slot 24. Blade 14 is pivotally movable about pivot shaft 16 between the fully closed position (FIG. 1) and the fully open position (FIG. 2).

Figure 8:
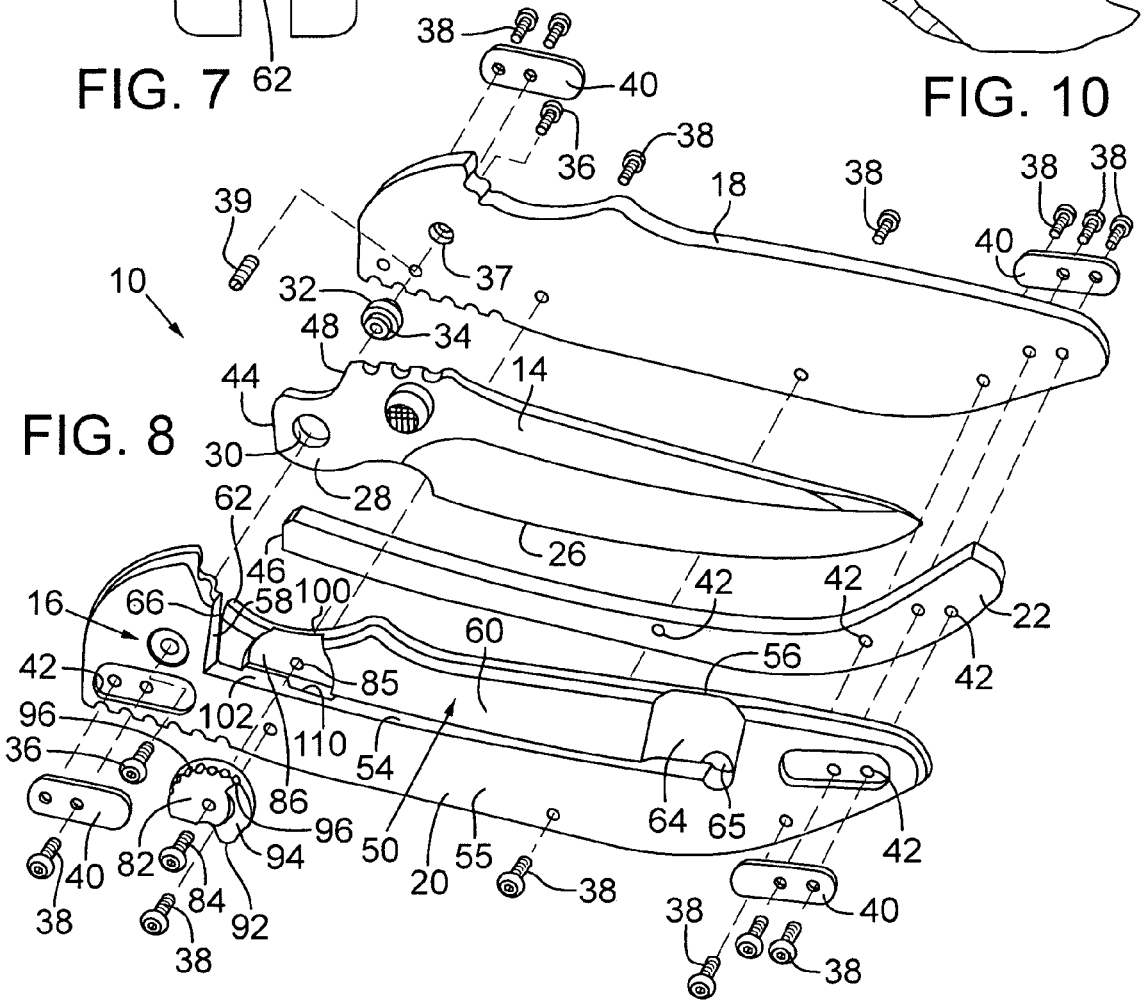
FIG. 8 is an exploded perspective view of the knife shown in FIG. 1, illustrating some of the component parts

With reference now to FIG. 8, additional structural parts of knife 10 will be identified beginning with blade 14, which includes a tang 28 having a bore 30 through which pivot shaft 16 extends. Specifically, pivot shaft 16 comprises a cylindrical bushing 32 that fits into bore 30 and has outer cylindrical portions 34 on both lateral sides that have stepped-down diameters relative to the central portion of bushing 32, and which are received into bores 37 formed in handles 18 and 20 in the assembled knife 10 (only one bore 37 is shown). Pivot shaft 16 includes a threaded screw 36 that extends through bushing 32 and engages a nut (not shown) to secure the blade to the handle 12. Blade 14 preferably includes a thumb lug 27 to assist with opening and closing the blade. The rearward end of tang 28 is formed into a flattened section 44, which as detailed below cooperates with a spring member to lock the blade in the open position.

The handle halves 18 and 20 are assembled with the blade 14 as just described. Spacer 22 is held in place with plural screws 38, which as shown best in FIG. 8, engage threaded openings 42 in spacer 22. It will be appreciated that the structural peculiarities such as number of screws 38 is not particularly important so long as the knife 10 is securely assembled. Some of the screws 38 may attach plates 40 to recesses 42 formed in the handle halves for added structural strength and/or aesthetics, and of course the screws 38 may thread completely through both handle halves and the spacer if desired. Screw 39 (FIGS. 3 through 7) acts as a blade stop pin, preventing rotation of the blade beyond the fully open position shown in FIG. 2.

The blade locking mechanism, identified generally with reference number 50, will now be described in detail. Handle half 20 is preferably made of a resilient material such as a variety metals and alloys. Handle half 20 comprises an integrally formed, bifurcated sheet comprising a base 52 having an elongate, L-shaped slot 54 extending from a relatively thinner wall section 56 in a forward direction and turning at a 90° angle and extending through the edge of the handle half at exit point 58. The elongate slot 54 defines a spring arm 60 having a free end 62 at the forward end of the spring arm, and an elongate fixed body portion 55 opposite of slot 54 from spring arm 60. The slot 54 further defines a base end 64 at a thinner wall section 56 near the rearward, terminal end of slot 54. A bore 65 may optionally be formed at the rearward, terminal end of slot 54 to provide more resiliency to the spring arm 60. The forward end of free end 62 of spring arm 60 is flattened to define a flattened face 66.

It will be appreciated that base end 64 extends integrally from base 52 in a one-piece construction. During fabrication of handle half 20, spring arm 60 is pre-stressed so that the spring arm is given an initial bias inwardly in the direction toward the blade-receiving slot 24—that is, generally into the plane of the paper in FIG. 1. The relatively thinner wall section 56 aids in facilitating the initial inward bias, but should be seen as optional. The inward bias is preferably sufficiently strong that the free end 62 of spring arm 60 will normally continue to be biased under spring pressure inwardly in the direction toward slot 24 until constrained against further movement by another structural component of the knife.

With reference to FIG. 1, blade 14 is in the closed position. In this position, the free end 62 of spring arm 60 is pressing inwardly against the blade and applying force thereto. The spring force applied against the blade in this manner helps retain the blade in the closed position.

The blade 14 is shown in the open position in FIG. 2. Here, blade 14 has rotated to the point where the flattened face 66 of free end 62 of spring arm 60 snaps behind the flattened portion 44 of tang 28 and blade stop pin 39 abuts an upper portion of tang 28. The spring force applied to spring arm 60 maintains the spring arm in this locking position, wherein the blade cannot be rotated from the open to the closed position because the free end 62 of the spring arm 60 is in an abutting relationship with the flattened portion 44 of tang 28. Preferably, the respective mating faces of flattened portion 44 and flattened face 66 of free end 62 may be cooperatively sloped in opposite directions relative to one another, in the manner of a conventional liner lock, to assist with the locking engagement between these two structures.

It will be appreciated that both handle halves may preferably be fabricated from the same type of material. Alternately, while handle half 20, which comprises locking mechanism 50, must be a resilient material, handle half 18 may be made of a different material if desired.

As noted above, the locking mechanism 50 of knife 10 includes a safety mechanism, which is identified generally with reference number 80. As detailed herein, safety mechanism 80 is operable to secure the locking mechanism 50 in the locked position of FIG. 2 to thereby prevent unintentional unlocking of blade 14 where it could inadvertently close, and also to prevent spring arm 60 from being forced so far in the unlocking direction when the blade is unlocked such that the spring arm could be damaged. Safety mechanism 80 further is operable to prevent spring arm 60 from moving in the direction transverse to the direction of the spring force, which further minimizes potential damage to the spring arm.

Figure 9:
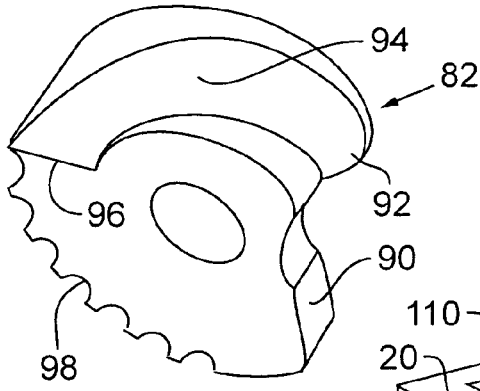
FIG. 9 is a perspective view showing in isolation the cam wheel used with the safety mechanism.

With reference to FIGS. 1 and 2, safety mechanism 80 comprises a semi-circular cam wheel or disk 82 rotatably attached with a screw 84 to a cooperatively sized, semi-circular cavity 86 formed near free end 62 of spring arm 60. Screw 84 is threaded into a cooperatively threaded opening 85 in the spring arm 60. The cam wheel 82 is shown in isolation in FIG. 9. In FIG. 9 it may be seen that the cam wheel includes a flattened portion 90 that bisects part of the generally circular cam and which extends across the cam toward a tab 92 that is formed opposite the flattened portion 90. A ramped or sloping section 94 extends annularly from tab 92 around a peripheral section that preferably measures between about 90° to about 160° along the peripheral edge of the cam wheel. Ramped portion 94 is defined by the cam wheel being milled so that the ramped portion is relatively thinnest near tab 92, and the thickness of the ramped portion gradually increasing along the length of the ramped portion until the terminal end 96 of the ramped portion, where the thickness of the ramped portion is the same as the thickness of the cam wheel. The cam wheel 82 includes a knurled peripheral edge portion 98 between the terminal end 96 and the flattened portion 90. The knurled peripheral edge allows the cam to be conveniently gripped by the user during operation of the cam wheel.

Cam wheel 82 is rotatably attached to spring arm 60 with a screw 84 as indicated in FIGS. 1, 2 and 8 in a cavity 86 milled into the spring arm. The cavity 86 is generally cylindrical so that it accepts cam wheel 82 and allows the cam wheel to rotate in the cavity. The radius of cam wheel 82 measured from its center to knurled edge portion 98 is greater than the distance from opening 85 in spring arm 60 to the exposed edge 100 of the spring arm. As such, when the cam wheel is attached to the spring arm as shown in the drawings, the knurled portion is exposed so that a user may conveniently rotate the cam wheel with one finger, as best illustrated in FIGS. 1 and 2.

Figure 10:
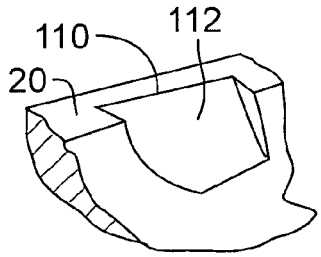
FIG. 10 is a cutaway view of a portion of the knife handle, illustrating the cavity formed in the knife handle for receiving a portion of the cam wheel shown in FIG. 9.

With specific reference to FIGS. 8 and 10, and as described below, a cooperatively formed notch or cavity 110 is milled or otherwise formed in fixed body portion 55 in a location so that portions of cam wheel 82 spans or extends across slot 54 and engage the cavity 110 as the cam wheel 82 as it is rotated. Cavity 110 is semi-circular in shape and is formed so that it has an annular ramped portion 112 that is cooperatively formed and oppositely sloped relative to ramped portion 94 of cam wheel 82.

Figure 4:
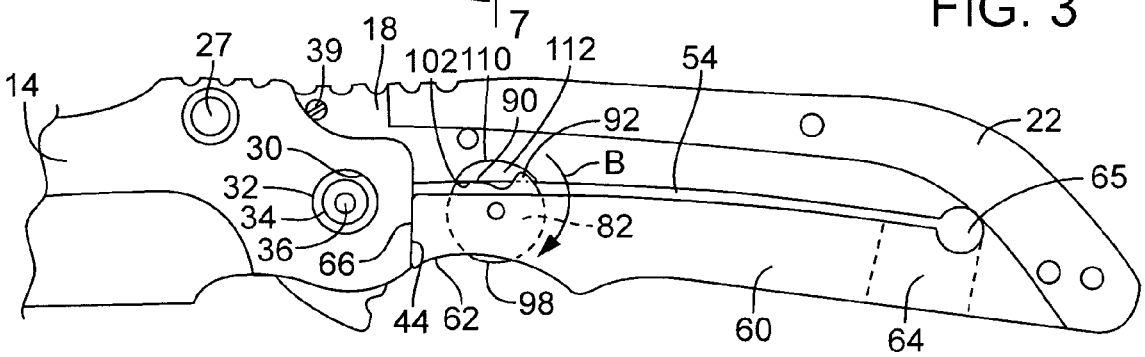
FIG. 4 is a side elevation view similar to the illustration of FIG. 3, but in which the safety mechanism is in the released or unlocked position so that the locking mechanism may be unlocked.
Figure 5:
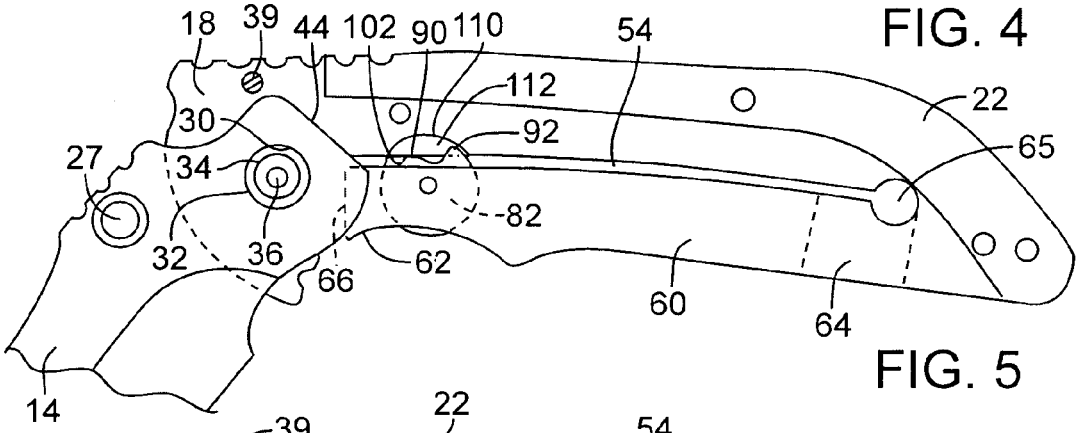
FIG. 5 is a side elevation view similar to the illustration of FIG. 4, showing the blade being partially rotated toward the closed position in which the blade is stowed in the handle.
Figure 6:
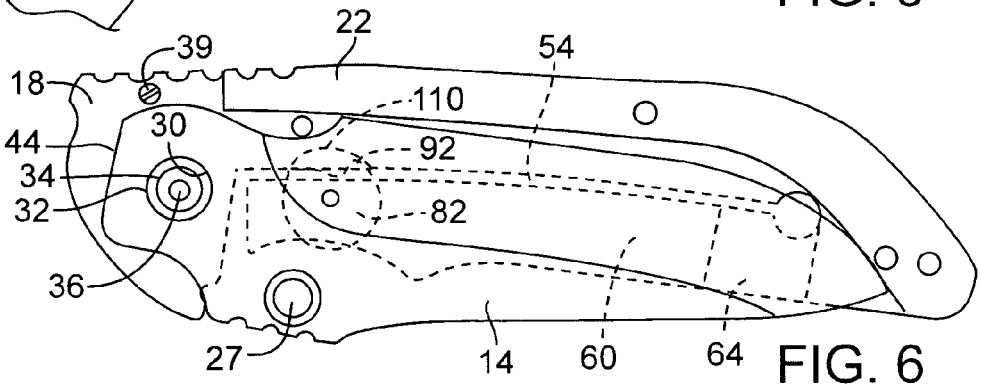
FIG. 6 is a side elevation view similar to the illustration of FIG. 5, showing the blade being fully rotated into the closed position in which the blade is stowed in the handle.
Figure 7:
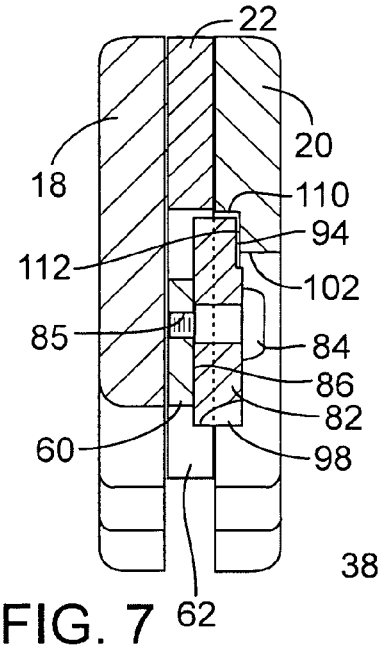
FIG. 7 is a sectional view taken along the line 7-7 of FIG. 3.

When cam wheel 82 is assembled as shown in FIGS. 1 and 2 it may be rotated in the clockwise and counter clockwise directions between two ending positions. In the first position, shown in FIG. 1 where blade 14 is in the closed position, cam wheel 82 is rotated fully counter clockwise (from the perspective of the viewer in the drawing). In this position, flattened portion 90 of cam wheel 82 is parallel to and abuts flattened surface 102 of elongate body 55 in slot 54, thereby preventing further rotation of the cam wheel in the counterclockwise direction. This position of the cam wheel 82 is referred to as the open or unlocked position, and is also shown in FIGS. 4, 5 and 6, wherein it may be seen that tab 92 extends across slot 54 so that the tab extends at least partially into cavity 110.

Figure 3:
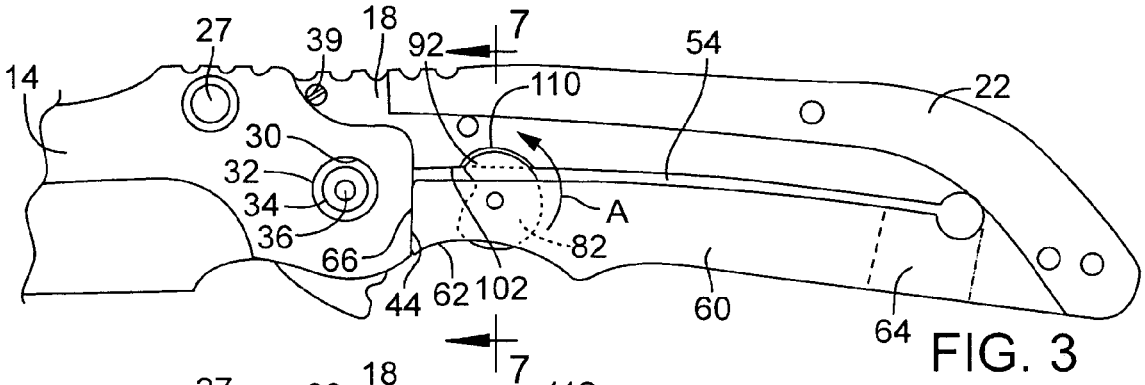
FIG. 3 is a side elevation view of the knife shown in FIG. 1 with the handle half on the near side removed to expose and illustrate the locking mechanism and the safety mechanism.

Referring now to FIGS. 2 and 3, blade 14 is shown in the fully open position and locked in that position by the locking engagement described above between flattened face 66 of spring arm 60 and rearward flattened portion 44 of tang 28. Spring arm 60 may be safely locked in this locking position by rotation of cam wheel 82 fully in the clockwise direction in FIG. 2—this position of the cam wheel is referred to as the locked position. This same position is shown in FIG. 3, but because FIG. 3 shows the opposite side of knife 10 from the view of FIG. 2, the rotational direction of cam wheel 82, as shown by arrow A, is reversed and thus counter clockwise.

In this position, annular ramped portion 94 of cam wheel 82 engages the oppositely sloped ramped portion 112 of cavity 110. Accordingly, as cam wheel 82 is rotated toward the locked position, the ramped portion 94 on cam wheel 82 engages and abuts the ramped portion 112 of cavity 110. As the wheel is rotated, the abutting, oppositely sloped ramped portions 110 and 112 bear against and thus exert pressure against one another, with the result being that pressure is exerted by cam wheel 82 on elongate body portion 55. This inwardly directed pressure (i.e., toward the blade receiving groove 24) further drives and urges spring arm 60 toward the locked position, in addition to the normal spring force that drives the spring arm toward the locked position. The cam wheel 82 is retained in this position by virtue of the frictional contact between ramped portions 94 and 112. The blade is thus safely locked in the fully open position, and the spring arm 60 cannot be moved to the unlocking position because cam wheel 82 is engaging the elongate body portion 55.

Moreover, with cam wheel 82 in the locked position shown in FIG. 3, the outer peripheral annular edge of the cam wheel at ramped portion 94 lies in close tolerance proximity to the annular border of cavity 110. As a result, the free end 62 of spring arm 60 cannot move in the direction toward elongate body portion 55. Stated another way, slot 54 is wide enough that absent cam wheel 82, the free end 62 could be deflected slightly in the direction toward spacer 22. This movement can cause wear between the abutting surfaces at 66 and 44 when the blade is in the open position. Wear on these surfaces could loosen the locking relationship. However, because the outer periphery of the cam wheel is in close tolerance to the wall of cavity 110, movement of the spring arm in this direction is eliminated, thus eliminating wear on the surfaces at 66 and 44.

The procedure for unlocking the knife will now be described with reference to FIGS. 4 and 5. With blade 14 in the open position the blade locked by virtue of blade lock mechanism 50 (FIG. 2), and with safety mechanism 80 in the locked position, cam wheel 82 is rotated in the direction of arrow B in FIG. 4 (clockwise in FIG. 4, which correlates to counter clockwise in FIG. 1). The cam wheel is rotated until flattened section 90 abuts surface 102, thereby stopping rotation of the cam wheel. As noted above, in this position, tab 92 spans slot 54 and extends into cavity 110. However, as noted the cam wheel 82 is relatively thinnest at tab 92. This, combined with the fact that body 55 is relatively thinner at cavity 110 allows the free end 62 of spring arm 60 to move outwardly, out of the locking position a sufficient distance so that the blade may be disengaged from the lock-that is, the flattened face 66 of spring arm 60 may be disengaged from the flattened portion 44 of tang 28. Once the locking engagement between the blade tang and the spring arm is disengaged, blade 14 is free to be rotated toward the closed position, as shown in FIG. 5.

Because the tab 92 extends across the slot 54 and into the cavity 110, free end 62 of spring arm 60 is prevented from moving outwardly, i.e., away from blade 14, more than is necessary to allow the blade to be closed. Stated another way, with cam wheel 82 in the position shown in FIGS. 1, 4, 5 and 6, when the free end 62 of spring arm 60 is moved outwardly, away from blade 14, the tab 92 engages or contacts body 55 in cavity 110, limiting movement of the free end in the direction away from the blade, thereby preventing movement of the free end beyond the position where the tab contacts the wall of the cavity. There is a sufficient amount of movement of free end 62 to disengage the locking mechanism, but the amount of movement is limited, which prevents the spring arm from being "hyper extended" in the outward direction, against the spring force of the spring arm, which could damage the spring arm and render it inoperable for its locking functionality, or diminish the functionality of the locking mechanism.

It will be appreciated by those of ordinary skill in the art that various modifications may be made to the mechanisms described above without departing from the scope of the invention defined in the claims. For example, the safety mechanism 80 may be fabricated with a longitudinally slidable button attached to the spring arm and slidable in a direction generally transverse to the longitudinal axis of the handle toward and into cooperatively formed slot in the fixed body portion, the button and the fixed body portion preferably having cooperatively and oppositely sloped mating surfaces. Similarly, although the cam wheel 82 and the slidable button just described preferably include cooperatively sloped mating surfaces so that the spring arm is driven toward the locked position, an equivalent safety mechanism may be made without the sloping surfaces.

The length of the spring arm, and also the relative biasing strength of the spring arm, may be varied widely by varying the length of slot 54.

Furthermore, the tab 92 may be eliminated from cam wheel 82. Although removal of tab 92 will allow spring arm 60 to be moved outwardly and hyper extended as described above, the safety mechanism 80 remains functional to secure the locking mechanism 50 in the locked position. Finally, the safety mechanism defined by cam wheel 82 may be reversed from the position shown in the drawings.

While the present invention has been described in terms of a preferred embodiment, it will be appreciated by one of ordinary skill that the spirit and scope of the invention is not limited to those embodiments, but extend to the various modifications and equivalents as defined in the appended claims.

I claim:

1. A folding knife, comprising:

a handle comprising a first handle side wall and a second handle side wall, said first and second handle side walls spaced apart to define a blade-receiving groove, said first handle side wall having a slot formed therein extending along a length thereof and to an edge thereof to define in said first handle side wall a spring arm and a fixed body portion, the spring arm having a free end and being normally biased toward said second handle side wall;

a blade having a working portion and a tang portion, said tang portion having an end portion and said tang portion pivotally attached to said handle so that said blade is pivotal between an open position and a closed position, wherein in said open position the free end of said spring arm engages said end portion of said tang portion to prevent said blade from pivoting to said closed position; and a safety member mounted to said spring arm, said safety member configured for spanning said slot and engaging said fixed body portion.

2. The folding knife according to claim 1 in which the spring arm is movable between a blade locking position wherein the free end of said spring arm engages said end portion of said tang portion, and a blade unlocking position wherein the free end of said spring arm may be disengaged from said end portion of said tang portion.

3. The folding knife according to claim 2 wherein in a first position said safety member engages said fixed body portion when the spring arm is in the blade locking position to prevent said spring arm from being moved to said blade unlocking position.

4. The folding knife according to claim 3 wherein in a second position said safety member engages said fixed body portion and allows the spring arm to be moved to said blade unlocking position.

5. The folding knife according to claim 2 wherein said safety member is defined by a semi-circular wheel that may be rotated to a first position in which a portion of said wheel engages said fixed body portion to lock said spring arm in the blade locking position.

6. The folding knife according to claim 5 wherein said wheel can be rotated to a second position in which said spring arm can be moved to the blade unlocking position.

7. The folding knife according to claim 6 wherein said wheel further includes a tabbed portion, and when said wheel is in the second position said tabbed portion spans said slot and makes contact with said fixed body portion when said spring arm is moved to the blade unlocking position.

8. The folding knife according to claim 5 wherein said semi-circular wheel includes a sloped portion that extends around a periphery of said wheel.

9. The folding knife according to claim 8 wherein in said first position said sloped portion of said wheel engages said fixed body portion.

10. The folding knife according to claim 9 wherein said sloped portion of said wheel engages a cooperatively and oppositely sloped portion of said fixed body portion when the wheel is in the first position.

11. In a folding knife having an elongate body having a forward end and a rearward end, the body formed by two opposed side walls forming a channel therebetween, and a blade with a tang pivotally attached to the body at the forward end so the blade is movable from an open position to a closed position, the improvement comprising:

one of said side walls bifurcated with a slot to define a spring and a fixed body portion, said spring movable between a locked position where a forward end of the spring engages the tang when the blade is in the open position, and an unlocked position where the forward end of the spring disengages the tang and allows the blade to be moved to the closed position; and a safety mounted on said spring and movable between a first position in which the safety engages said fixed body portion to lock said spring in the locked position, and a second position in which said spring may be moved to the unlocked position.

12. The folding knife according to claim 11 wherein the spring is biased in the direction toward the blade.

13. The folding knife according to claim 11 wherein said safety spans said slot in both the first and second positions.

14. The folding knife according to claim 13 wherein in the first position said safety exerts pressure against said fixed body portion to retain said spring in said locked position.

15. The folding knife according to claim 14 wherein in the second position the safety limits the distance that the spring can be moved from the locked position.

16. A folding knife, comprising:

a handle having a first handle half and a second handle half, said first and second handle halves held spaced apart to define a groove therebetween, said first handle half having a slot extending along a length thereof and to an edge thereof to define a spring arm having a free end, and a fixed body portion;

a blade pivotally attached at a tang portion thereof to said handle, said blade pivotal between an open position and a closed position and said tang portion including a locking surface, said spring arm movable between a locked position when said blade is in the open position and the free end of said spring arm engages the locking surface of said tang portion, and an unlocked position; and safety means mounted to said spring arm for locking said spring arm in said locked position, said safety means including a safety member and wherein safety means is movable between a safe position wherein said safety member engages said fixed body portion, and a release position wherein said safety member at least partially disengages said fixed body portion.

17. The folding knife according to claim 16 wherein said safety member further comprises a semi-circular disk rotatably mounted to said spring arm.

18. The folding knife according to claim 17 wherein said semi-circular disk includes an annular sloped portion extending around a peripheral portion of said disk and terminating at a tab, and wherein in said safe position said annular sloped portion bears against a cooperatively sloped portion on said fixed body portion.

19. The folding knife according to claim 18 wherein when said semi-circular disk is in the release position, said tab extends across said slot so that said tab engages said fixed body portion when said spring arm is moved to the unlocked position.

* * * * *